US006128461A

United States Patent [19]

Yoshikawa

[11] Patent Number: 6,128,461

[45] Date of Patent: Oct. 3, 2000

[54] IMAGE FORMING APPARATUS

[75] Inventor: Tadanobu Yoshikawa, Mishima, Japan

[73] Assignee: Canon Kabushiki Kaisha, Tokyo, Japan

[21] Appl. No.: 09/207,144

[22] Filed: Dec. 8, 1998

[30] Foreign Application Priority Data

Dec. 11, 1997 [JP] Japan ..... 9-341204

[51] Int. Cl.[7] ..... G03G 21/00

[52] U.S. Cl. ..... 399/350; 399/351

[58] Field of Search ..... 399/350, 345, 399/351

[56] References Cited

U.S. PATENT DOCUMENTS 3,848,993 11/1974 Hasiotis ..... 399/351

5,842,102 11/1998 Montfort et al. ..... 399/349

*Primary Examiner*—Arthur T. Grimley
*Assistant Examiner*—Greg Moldafsky
*Attorney, Agent, or Firm*—Fitzpatrick, Cella, Harper & Scinto

[57] ABSTRACT

An image forming apparatus includes a cleaning device having a cleaning blade, including a toner image bearing member for bearing a toner image, a cleaning blade for frictionally removing residual toner remaining on the bearing member after a transferring process, and a device for applying vibration to the cleaning blade. Further, the vibration applied to the cleaning blade has a stead-state waveform. The vibration applying device may be a device for a vibration waveform having a frequency and an amplitude required for providing energy for obtaining a cleaning action, which vibration waveform is to be applied to the cleaning blade.

21 Claims, 8 Drawing Sheets

LOW PRESS (FRICTIONAL) FORCE

MAX. AMPLITUDE 0.7μm
VIBRATION FREQUENCY 120Hz

SUITABLE PRESS (FRICTIONAL) FORCE

MAX. AMPLITUDE 0.3μm
VIBRATION FREQUENCY
80Hz AND 120Hz

HIGH PRESS (FRICTIONAL) FORCE

MAX. AMPLITUDE 1.0μm
VIBRATION FREQUENCY 80Hz

DEFORMED BLADE EDGE RESTORED BY REPEL RESILIENT FORCE OF BLADE (RESILIENT MEMBER) (SLIP STATE)

BLADE EDGE CONTACTED DRUM DEFORMED FOLLOWING TO DRUM (STICK STATE)

ABUT FORCE OF RUBBER BLADE TO DRUM SURFACE IS SUITABLE

ABUT FORCE OF RUBBER BLADE TO DRUM SURFACE IS SMALLER THAN SUITABLE VALUE

ABUT FORCE OF RUBBER BLADE TO DRUM SURFACE IS LARGER THAN SUITABLE VALUE

IMAGE FORMING APPARATUS

BACKGROUND OF THE INVENTION

1. Field of the Invention

The present invention relates to an image forming apparatus of electrophotographic or electrostatic type such as a copying machine, a laser beam printer and the like for visualizing a latent image formed on an image bearing member by adhering developing agent to the latent image.

2. Related Background Art

In image forming apparatuses, an electrostatic latent image formed on a surface of a moving image bearing member is developed by a developing means as a toner image which is in turn transferred onto a transfer material. Residual toner which has not been transferred to the transfer material and remains on the surface of the image bearing member is cleaned and removed by a cleaning device. In such a cleaning device, a cleaning blade made of elastic material such as rubber has been widely used as a cleaning means for removing the residual toner, for the reason that the cleaning device using the cleaning blade can be made simpler, compact and inexpensive. As material of the cleaning blade, polyurethane rubber has mainly been used in consideration of medical resistance, anti-wear, forming ability and mechanical strength.

In the cleaning device having the cleaning blade, there is an arrangement in which the cleaning blade is urged against the surface of the image bearing member from a counter direction. In a cleaning action of this arrangement, when the cleaning blade is urged against the surface of the image bearing member with a force (5 to 40 gf/cm) required for removing the residual toner from the surface of the image bearing member, at a contact portion between an edge portion of the cleaning blade and the image bearing member, first of all, the edge portion of the cleaning blade closely contacted with the surface of the image bearing member is deformed (deviation deformation or compression deformation) in an advancing direction of the image bearing member by a frictional force acting on the contact portion, and then, energy accumulated in the edge portion of the cleaning blade due to stress acts as a restoring force (repelling elastic force) to return the blade to its original condition (so-called stick-slip movement) as shown in FIGS. 6A and 6B.

From the aforementioned explanation, in the cleaning devices using the cleaning blade, the cleaning ability is determined by an amplitude and a frequency of a vibration movement effected by the energy accumulated in the edge portion of the cleaning blade, i.e., the stick-slip movement of the edge portion of the cleaning blade. Further, ideally, for example, in case of a cylindrical image bearing member (photosensitive drum), it is preferable that the vibration movement of the edge portion of the cleaning blade is limited to occur in a tangential plane of the cylinder.

The amplitude and frequency of the stick-slip movement are optimized by adjusting the coefficient of friction of the contact portion between the edge portion of the cleaning blade and the surface of the image bearing member, the configuration of the cleaning blade, and the properties (Young's modulus, Poisson's ratio and modulus (stress-strain curve)) of the material of the cleaning blade.

In such a cleaning device, even if the above-mentioned optimization is effected under an initial condition, for example, when the coefficient of friction of the surface of the image bearing member is increased or when the cleaning blade is permanently deformed due to hydrolysis, the state of the stick-slip movement of the edge portion of the cleaning blade is changed, thereby giving rise to various problems (refer to FIGS. 7A to 7C).

Firstly, as the coefficient of friction of the surface of the image bearing member is increased, for example, by adhering the toner to such surface, the frictional force between the edge portion of the cleaning blade and the image bearing member (contact portion) is naturally increased (i.e., the apparent abut force is increased; refer to FIG. 7C). Thus, the energy accumulated in the edge portion of the cleaning blade in the stick-slip condition is increased, so that the amplitude of the stick-slip movement becomes greater than a suitable value and the frequency of the stick-slip movement becomes smaller than a suitable value. As this phenomenon increases, the edge portion of the cleaning blade jumps up without following to the surface of the image bearing member, thereby causing toner to escape, toner adhesion to the surface of the image bearing member (toner fusion or filming), abnormal noise (vibration noise of blade), abnormal vibration (tremble), so-called blade take-off (in which the blade edge portion is reversed along the rotational direction of the image bearing member), and/or, damage of the edge portion of the cleaning blade and/or the surface of the image bearing member (tearing of the blade edge, scratching of the surface of the image bearing member).

In order to solve such problems, conventionally, the frictional force has been reduced by coating, on the contact portion between the tip end of the cleaning blade and the image bearing member, solid powder (lubricating agent) of inorganic substance such as graphite, boron nitride, molybdenum disulfate, tungsten disulfate or silicon dioxide, or, solid powder (lubricating agent) of organic substance such as fluororesin, silicone resin, polyamide (nylon resin), polyacetal, polyethylene or polyimide. However, as the apparatus is used for a long time the lubricating agent begins to disappear from the edge portion of the cleaning blade, since the frictional force is increased again, such a coating method is not a complete solution for reducing the frictional force. Further, although various apparatuses for continuously supplying the lubricating agent to the edge portion of the cleaning blade have been proposed, such cleaning apparatuses are complicated and expensive, and, thus, have not yet been put to practical use.

Further, in the past, OPC (organic photo semi-conductor) photosensitive drums having a surface layer using polycarbonate as binder resin have widely been used as the image bearing members. Among them, in some photosensitive drums, a protection layer (OCL) is formed by dispersing a suitable amount (3 to 40 wt %) of Teflon resin in the polycarbonate binder resin on the surface of the photosensitive drum in order to solve the above problem. By using the photosensitive drum having the protection layer (OCL) as an outermost layer and by adding inorganic fine particles (having a diameter of 1 $\mu$m or less) of strontium titanate, cerium oxide, alumina or zirconia (surfaces of which are subjected to hydrophobic treatment) to the toner, such inorganic fine particles are accumulated on the contact portion between the edge portion of the cleaning blade and the image bearing member, so that the Teflon resin included in OCL is supplied to the contact portion when the OCL surface is polished, thereby promoting the lubricating effect. However, when a large number of images using a very small amount of toner are copied continuously, as the number of copies is increased, the amount of the inorganic fine particles for providing the polishing effect on the contact portion between the edge portion of the cleaning blade and the image bearing member is greatly reduced, thereby causing the abnormal vibration and blade take-off.

Further, as a method for reducing the frictional force between the cleaning blade and the image bearing member, there has been proposed a technique in which a cleaning blade coated by a nylon resin layer (referred to as "nylon coat blade" hereinafter) is used to be contacted with the image bearing member. When such a nylon coat blade is used, a frictional force between an edge portion of the nylon coat blade and the image bearing member can be sufficiently reduced. However, unlike polyurethane, since the nylon resin has no elastomer property, it is considered that a cleaning action (due to the stick-slip movement of the edge portion of the cleaning blade) for removing the residual toner is not effected but the residual toner is blocked to scrape the toner. Thus, the abut force of the cleaning blade against the surface of the image bearing member must be increased considerably in comparison with polyurethane (about two times in comparison with polyurethane), so that an abrasion amount of the surface of the image bearing member (caused by the cleaning blade) is increased and/or the surface of the image bearing member is damaged, thereby shortening the service life of the image bearing member.

Secondly, for example, if the cleaning blade is permanently deformed by hydrolysis, the abut force of the cleaning blade against the surface of the image bearing member is decreased, so that the frictional force (on the contact portion) between the edge portion of the cleaning blade and the surface of the image bearing member is reduced (refer to FIG. 7A). Thus, the energy accumulated in the edge portion of the cleaning blade in the stick-slip condition is reduced, so that the amplitude of the stick-slip movement becomes smaller than the suitable value and the frequency of the stick-slip movement becomes greater than the suitable value. When this phenomenon is grown, the edge portion of the cleaning blade does not move (vibrate) on the surface of the image bearing member not to remove the residual toner completely. Further, escape of toner may occur and/or the surface of the image bearing member may be damaged by the toner accumulated and solidified on the edge portion of the cleaning blade.

In order to solve the above problem, it is required that the use time period of the cleaning blade is determined from permanent deformation tests of the cleaning blades under a high temperature/humidity condition and that, when the use time period is expired, the cleaning blade is exchanged to a new one.

However, in this case, actually, even the cleaning blade still having the service life has been exchanged, thereby increasing the running cost. Further, in this case, when the cleaning blade alone is exchanged, the contact between the new cleaning blade and the still used image bearing member does not become familiar, thereby causing toner to escape, damage to the surface of the image bearing member and/or blade take-off.

As mentioned above, the stick-slip movement utilizing the frictional force (abut force of the edge portion of the cleaning blade against the surface of the image bearing member) on the contact portion between the edge portion of the cleaning blade and the surface of the image bearing member is quite unstable for endurance, which may result in damage of the cleaning blade and the image bearing member.

In FIG. 7B, regarding the cleaning vibration, the stick-slip movement of the blade edge is optimized. Further, regarding the up/down vibration, the blade edge is almost not moved up and down.

However, in FIG. 7A, regarding the cleaning vibration, since the abut force is small, the stick-slip movement of the blade edge becomes small, thereby worsening the cleaning ability. Further, regarding the up/down vibration, since the abut force is small, the blade edge is moved up and down on the surface of the image bearing member, thereby affecting a bad influence upon the cleaning ability. If the cleaning ability is worsened, there arise problems such as escape of toner, lateral stripes, scratch and toner fusion.

In FIG. 7C, regarding the cleaning vibration, since the abut force is too great, the stick-slip movement of the blade edge becomes unstable, thereby causing the abnormal vibration and abnormal noise. Further, regarding the up/down vibration, since the abut force is too great, the blade edge is jumped up to vibrate up and down on the surface of the image bearing member, thereby affecting a bad influence upon the cleaning ability. As a result, there arise problems such as abnormal vibration of the blade, blade take-off, abnormal noise of the blade, lateral stripes, scratching and toner fusion.

SUMMARY OF THE INVENTION

The present invention aims to solve the above-mentioned conventional problems, and has an object to provide an image forming apparatus which can prevent escape of toner, toner fusion on a surface of an image bearing member, abnormal noise, abnormal vibration and blade take-off to obtain a high quality image and to ensure high endurance.

To achieve the above object, the present invention provides an image forming apparatus including a cleaning device having a cleaning blade, wherein the image forming apparatus comprises a toner image bearing member for bearing a toner image, a cleaning blade for frictionally removing residual toner remaining on the bearing member after a transferring process, and a device for applying vibration to the cleaning blade.

In the vibration applying device, a vibration waveform applied to the cleaning blade may be a steady-state wave. In the vibration applying device, a vibration waveform applied to the cleaning blade may have a frequency and an amplitude required for providing energy generating a cleaning action. Further, there may be provided a device for detecting a vibration condition of the cleaning blade, so that the state of the vibration applied to the cleaning blade can be controlled and altered on the basis of the detected vibration condition.

DESCRIPTION OF THE PREFERRED EMBODIMENTS

The embodiments of present invention will now be fully explained with reference to the accompanying drawings.

Figure 1:
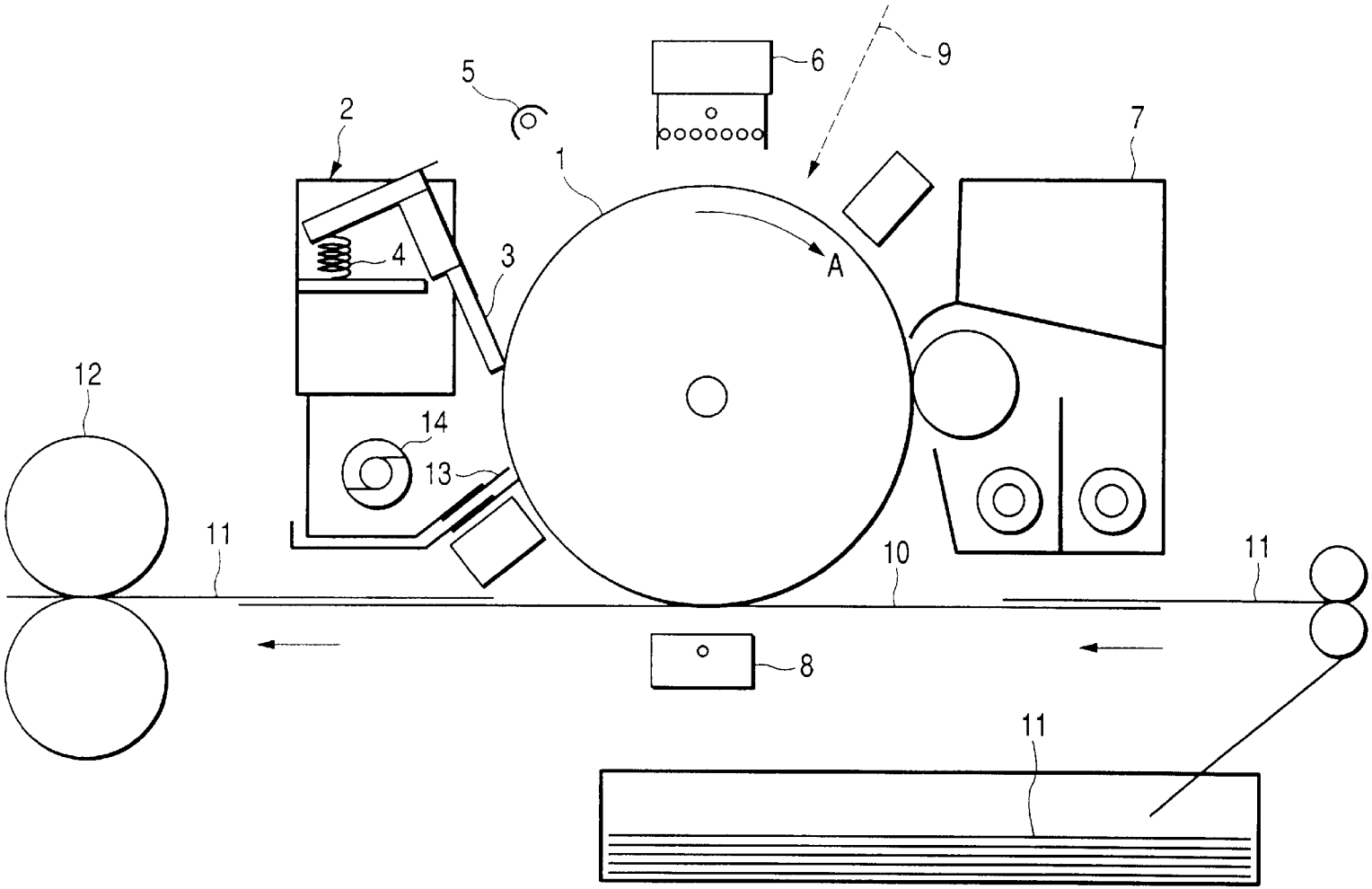
FIG. 1 is a sectional view showing main parts of a conventional image forming apparatus.

In FIG. 1 which is a schematic sectional view showing main parts of an image forming apparatus according to the present invention, around a photosensitive drum (image bearing member) 1 rotated in a direction shown by the arrow A, there are disposed a cleaning device (cleaning means) 2, and various electrophotographic recording process equipments (pre-exposure light source 5, a first charger 6, a developing device 7 and a transfer charger 8). In the cleaning device 2, a cleaning blade 3 made of elastomer such as polyurethane rubber is urged against the photosensitive drum 1 by a pressure spring 4.

In the image forming apparatus, after charges are removed from a surface of the photosensitive drum 1 by the pre-exposure light source 5, the photosensitive drum 1 is uniformly charged by the first charger 6, and a light image is exposed in a light exposure area 9. As a result, an electrostatic latent image corresponding to the light image is formed on the photosensitive drum 1, and the electrostatic latent image is developed by the developing device 7 to be visualized as a toner image. The toner image formed on the photosensitive drum 1 is transferred, by the action of the transfer charger 8, onto a transfer material 11 conveyed by a convey means 10. The transfer material 11 on which the toner image was borne is separated from the photosensitive drum 1 and then is sent to a fixing device 12 by the convey means 10. After the toner image is fixed to the transfer material 11 in the fixing device 12, the transfer material is discharged out of the apparatus.

On the other hand, residual toner which has not been transferred to the transfer material 11 and remains on the surface of the photosensitive drum 1 reaches the cleaning device 2, where the residual toner is scraped by the cleaning blade 3 (urged against the photosensitive drum by the pressure spring 4) from the surface of the photosensitive drum 1 onto a dip sheet 13. The scraped waste toner is collected into a waste toner container (not shown) by a waste toner convey screw 14 of the cleaning device 2.

In the cleaning device 2, energy required for scraping the residual toner on the surface of the photosensitive drum 1 is given by elastic energy accumulated on an edge portion of the cleaning blade 3 when the edge portion of the cleaning blade 3 is deformed by a frictional force between the edge portion of the cleaning blade and the surface of the photosensitive drum 1 while following a rotational direction of the photosensitive drum 1. Accordingly, in the cleaning device 2, in order to optimize a cleaning ability, configuration and material (various properties such as Young's modulus, Poisson's ratio and modulus (stress-strain curve)) of the cleaning blade 3 must be selected appropriately and a pressing force (load from the pressure spring 4) of the cleaning blade 3 against the surface of the photosensitive drum (image bearing member) 1 must be determined.

By optimizing the above condition (pressing force of the cleaning blade 3 against the surface of the photosensitive drum 1), a stick-slip movement (above-mentioned actual cleaning action) of the edge portion of the cleaning blade 3 can be achieved smoothly. In this case, a vibration condition (amplitude and frequency) of the stick-slip movement is unconditionally determined by the pressing force (frictional energy) of the cleaning blade 3 against the surface of the photosensitive drum 1. Accordingly, if the press force is always constant, it is considered that problems such as escape of toner, scratching of the surface of the photosensitive drum 1, toner fusion on the surface of the photosensitive drum 1, abnormal noise, abnormal vibration and blade take-off do not arise, thereby providing a stable cleaning action. However, in the actual cleaning device, as mentioned above, as the image forming apparatus is used for a long time, the pressing force of the cleaning blade 3 against the surface of the photosensitive drum 1 is changed to give rise to the above-mentioned problems.

Accordingly, these problems are solved by the stick-slip movement (giving the cleaning action) of the edge portion of the cleaning blade 3 obtained by applying vibration optimum to the cleaning action to the cleaning blade (rather than obtained by utilizing the conventional pressing force (frictional energy) of the edge portion of the cleaning blade against the surface of the photosensitive drum).

First Embodiment

Figure 2:
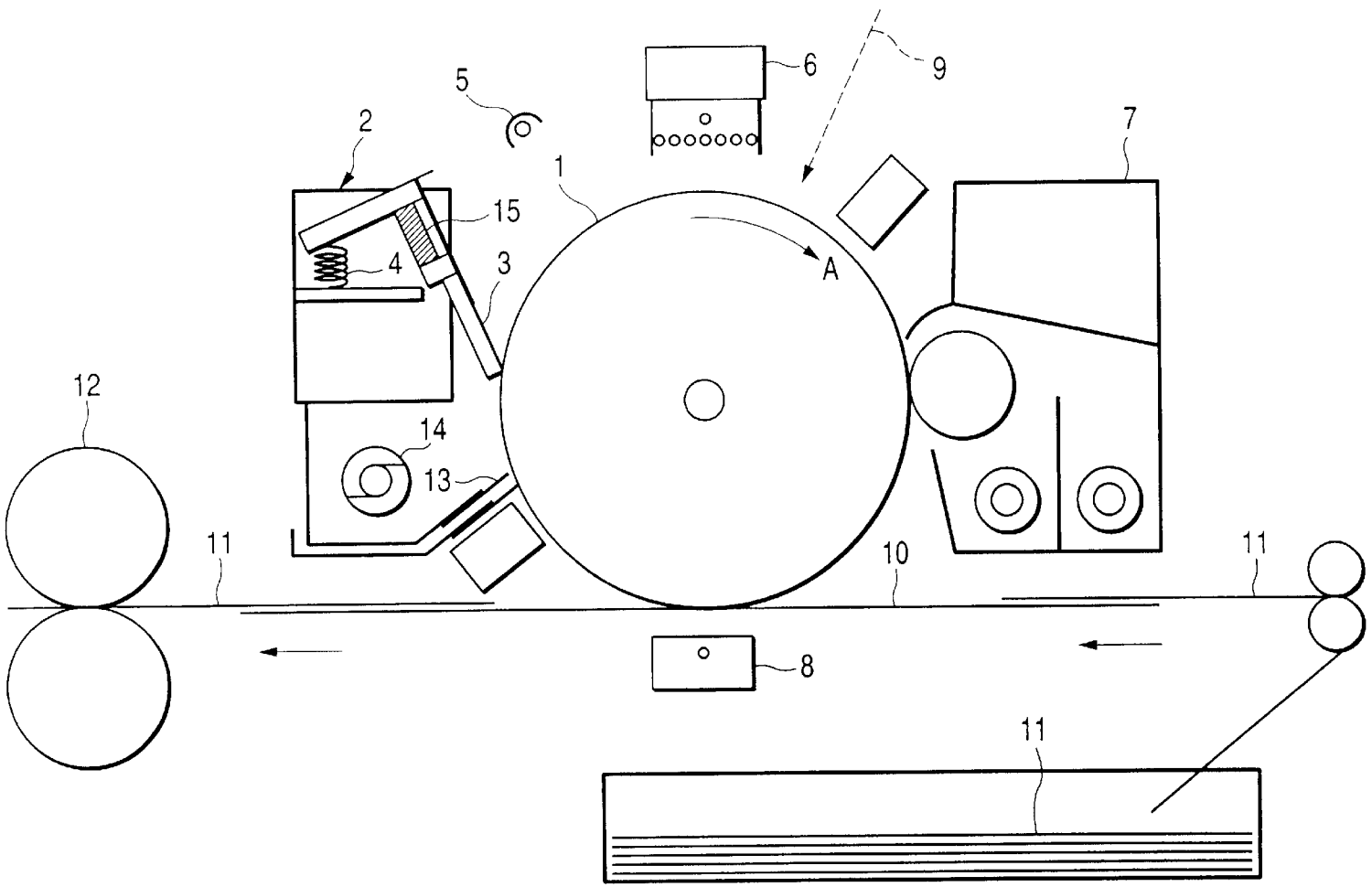
FIG. 2 is a sectional view of an image forming apparatus according to a first embodiment of the present invention.

FIG. 2 is a conceptional sectional view showing main parts of an image forming apparatus according to a first embodiment of the present invention. In FIG. 2, the same elements as those shown in FIG. 1 are designated by the same reference numerals and an explanation thereof will be omitted.

In this image forming apparatus, a piezo electric element (as a vibration applying device) 15 is provided on an attachment metal plate of the cleaning blade 3 so that vibration required for providing the cleaning action of the edge portion of the cleaning blade 3 is supplied by the piezoelectric element 15. In this case, a pressing force of the cleaning blade 3 against the surface of the photosensitive drum 1 is about 70% of the conventional case wherein the frictional energy is utilized. The reason is that the energy required for providing the cleaning action is not required to be supplied by the friction force between the edge portion of the cleaning blade 3 and the surface of the photosensitive drum 1 and that the pressing force may be an extent sufficient to contact the entire edge portion of the cleaning blade 3 with a longitudinal direction of the photosensitive drum 1. Incidentally, the frequency and amplitude of the vibration to be supplied are adjusted to be substantially the same as those of the vibration energy of the edge portion of the cleaning blade in the conventional cleaning device.

According to this embodiment, since various problems caused by the change in pressing force of the cleaning blade in the conventional cleaning device can be solved and the setting position of the pressing force can be lowered, the effective use time periods of the photosensitive drum 1 and the cleaning blade 3 can be lengthened by about two times.

Second Embodiment

Next, a second embodiment of the present invention will be explained.

Although the sufficient effect can be achieved only by the cleaning device 2 explained in connection with FIG. 2, in the actual cleaning action, the stick-slip movement is ideally effected in a tangential plane tangent to the generatrix of a cylindrical photosensitive drum, and vibration energy directed toward a normal axis of the photosensitive drum may become as small as can as possible.

Figure 3:
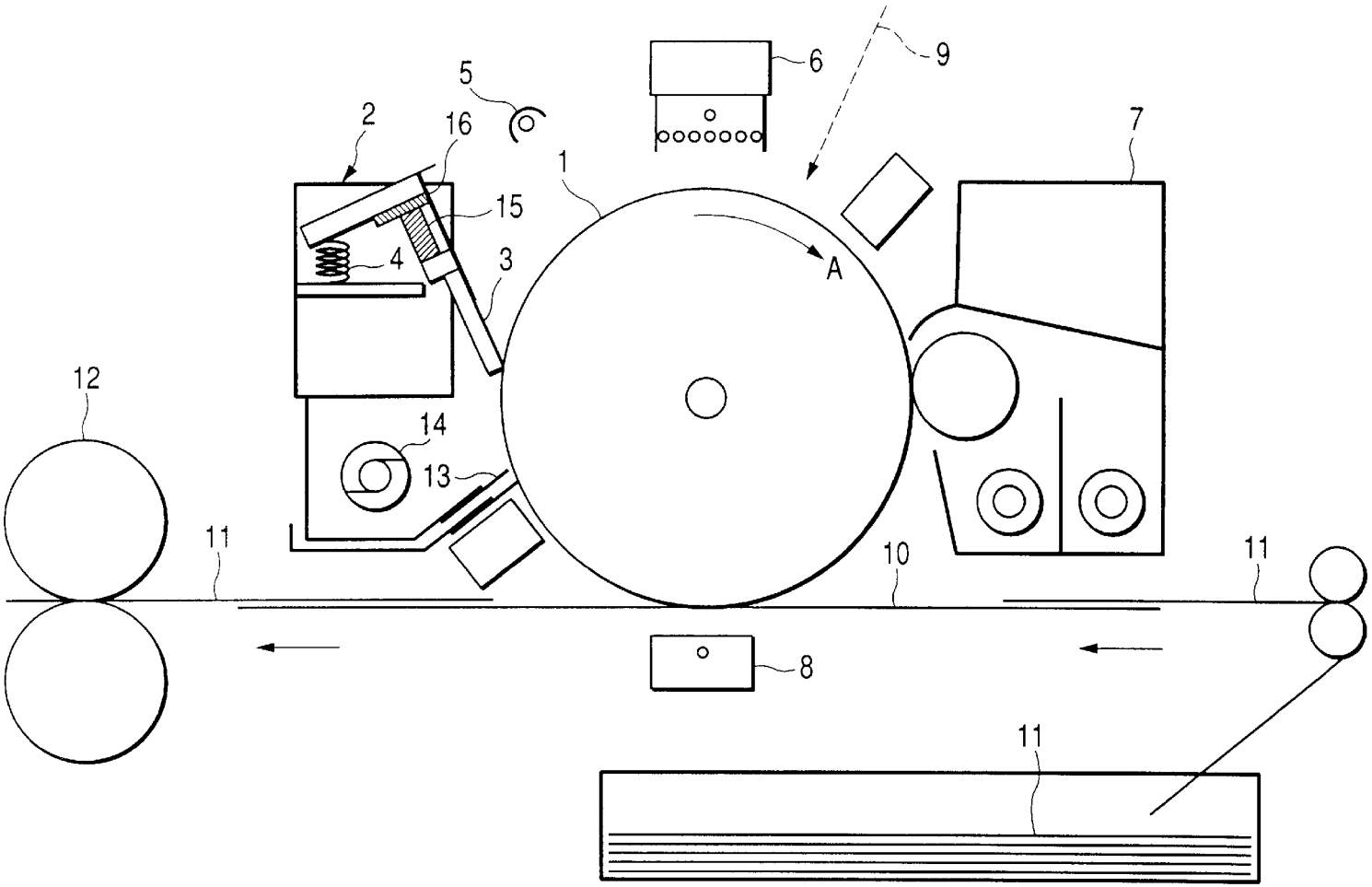
FIG. 3 is a sectional view of an image forming apparatus according to a second embodiment of the present invention.

Accordingly, in this embodiment, as shown in FIG. 3, a vibration proof member 16 is added to the attachment position of the cleaning blade 3. By the action of the vibration proof member 16, the vibration (of the edge portion of the cleaning blade 3) directing toward the normal axis of the photosensitive drum 1 can be prevented to reduce the damage of the surface of the photosensitive drum 1, thereby further lengthening the effective use time period of the photosensitive drum 1.

Third Embodiment

Next, a third embodiment of the present invention will be explained.

In the third embodiment, in the cleaning device 2 according to the above-mentioned embodiments, in order to further lengthen the effective use time periods of the cleaning blade 3 and the photosensitive drum 1, the vibration applied to the cleaning blade 3 is controlled on the basis of presence/absence of an image and image density (an amount of toner after the transferring). That is to say, other than the image formation, the vibration is not applied to the cleaning blade 3, and, during the image formation, the magnitude of the image density (amount of total residual toner) is detected by an image density reading sensor and the vibration applied to the cleaning blade 3 is changed accordingly.

According to this embodiment, by controlling the vibration to be applied, the damage of the surface of the photosensitive drum 1 is further reduced, thereby obtaining a high quality image for a long term.

Fourth Embodiment

Next, a fourth embodiment of the present invention will be explained.

Figure 4A:
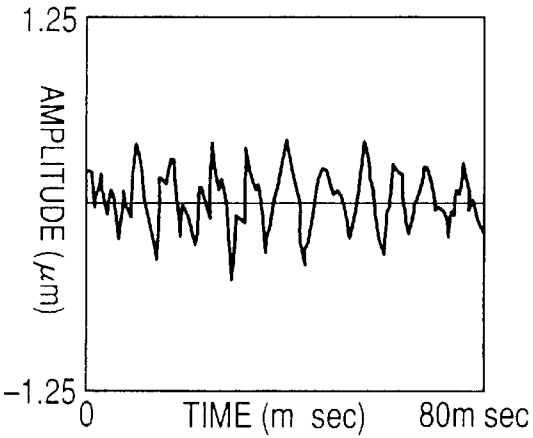
FIGS. 4A, 4B and 4C are views showing vibration wave forms (time areas) of a stick-slip movement of an edge portion of a cleaning blade in various vibration conditions.
Figure 4B:
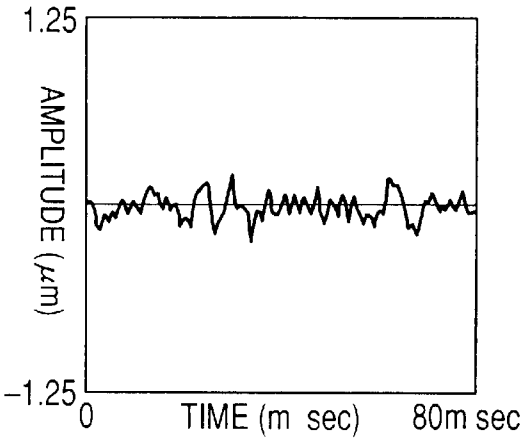
Figure 4C:
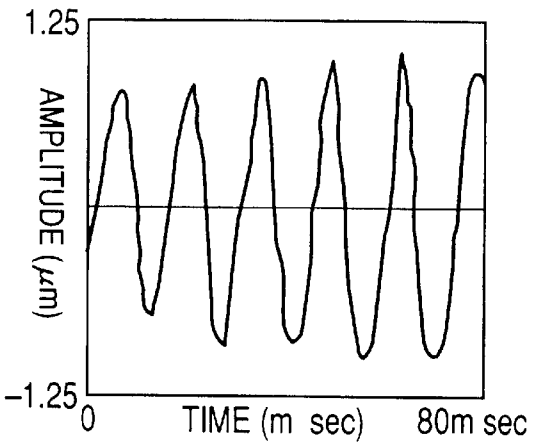

FIGS. 4A, 4B and 4C show vibration conditions (time areas) of the stick-slip movement of the edge portion of the cleaning blade in the actual cleaning device. The vibration condition (time area) is a component of the stick-slip movement of the edge portion of the cleaning blade, which component directs toward a normal axis (laser incident direction) to the photosensitive drum. The vibration of the edge portion of the cleaning blade is measured by a laser Doppler vibrometer. The vibration measurement is effected by illuminating a laser beam (irradiation area=ϕ 50 μm or less) onto the edge portion of the cleaning blade from a substantially normal direction to the photosensitive drum and by changing the pressing force (friction force in a wide sense) of the cleaning blade against the photosensitive to within a suitable range and high and low levels.

FIG. 4B shows the vibration condition (time area) of the stick-slip movement of the edge portion of the cleaning blade when the press force of the cleaning blade against the surface of the photosensitive drum is located within the suitable range. In this case, it was observed that a maximum amplitude is about 0.3 μm and frequency is about 80 Hz and about 120 Hz.

FIG. 4A shows the vibration condition (time area) of the stick-slip movement of the edge portion of the cleaning blade when the press force (frictional force between the edge portion of the cleaning blade and the photosensitive drum) of the cleaning blade against the surface of the photosensitive drum is smaller than the suitable range. In this case, it was observed that the maximum amplitude is about 0.7 μm and frequency is about 120 Hz. This means that the maximum amplitude is increased by two times or more and power spectrum intensity of about 120 Hz is increased by about several times, in comparison with the pressing force is within the suitable range.

Under such a vibration condition of the edge portion of the cleaning blade, as mentioned above, the escape of toner is caused or the toner accumulated on the edge portion of the cleaning blade is solidified to damage the surface of the photosensitive drum.

FIG. 4C shows the vibration condition (time area) of the stick-slip movement of the edge portion of the cleaning blade when the pressing force (frictional force between the edge portion of the cleaning blade and the photosensitive drum) of the cleaning blade against the surface of the photosensitive drum is greater than the suitable range. In this case, it was observed that the maximum amplitude is about 1.0 μm and frequency is about 80 Hz. This means that the maximum amplitude is increased by three times or more and power spectrum intensity of about 80 Hz is increased by about several times, in comparison with the pressing force is within the suitable range.

Under such a vibration condition of the edge portion of the cleaning blade, as mentioned above, toner adhesion (toner fusion filming) onto the surface of the photosensitive drum, abnormal noise (vibration noise of blade), abnormal vibration (tremble), blade take-off, and/or damage of the edge portion of the cleaning blade and/or the surface of the image bearing member (tearing of the blade edge, scratching of the surface of the image bearing member) of caused.

From the above measurement results, in the vibration condition of the edge portion of the cleaning blade, it was found that the smaller both the maximum amplitude and the power spectrum of the frequency, the better the cleaning condition and that the maximum amplitude and the frequency both have threshold values. That is to say, when the smooth cleaning action is performed, the stick-slip movement of the edge portion of the cleaning blade is ideally effected in the tangential plane tangent to the generatrix of the cylindrical photosensitive drum, and, it was found that, when the vibration energy of the edge portion of the cleaning blade acting toward the measurement direction this time (normal axis to the photosensitive drum) is small, the good cleaning condition is obtained.

Further, by measuring the vibration condition of the edge portion of the cleaning blade and by comparing the amplitude and the frequency with the respective threshold values, it can be judged which condition among the above-mentioned three vibration conditions shown in FIGS. 4A to 4C is now existed. That is to say, it can be judged whether the pressing force (frictional force between the edge portion of the cleaning blade and the photosensitive drum) of the cleaning blade against the surface of the photosensitive drum is greater or smaller than the suitable range, and, further, if such a vibration condition is continued, any problems which would be guessed to occur can be known previously.

Accordingly, by detecting the vibration condition of the edge portion of the cleaning blade, problems such as the escape of toner, damage to the surface of the photosensitive drum, toner fusion on the surface of the photosensitive drum, abnormal noise, abnormal vibration and blade take-off, which would be caused by the change in abut load of the cleaning blade against the surface of the photosensitive drum as the image forming apparatus is used for a long term can be previously known, and an automatic diagnosis for preventing occurrence of such problems by adjusting the abut load can be provided.

Figure 5:
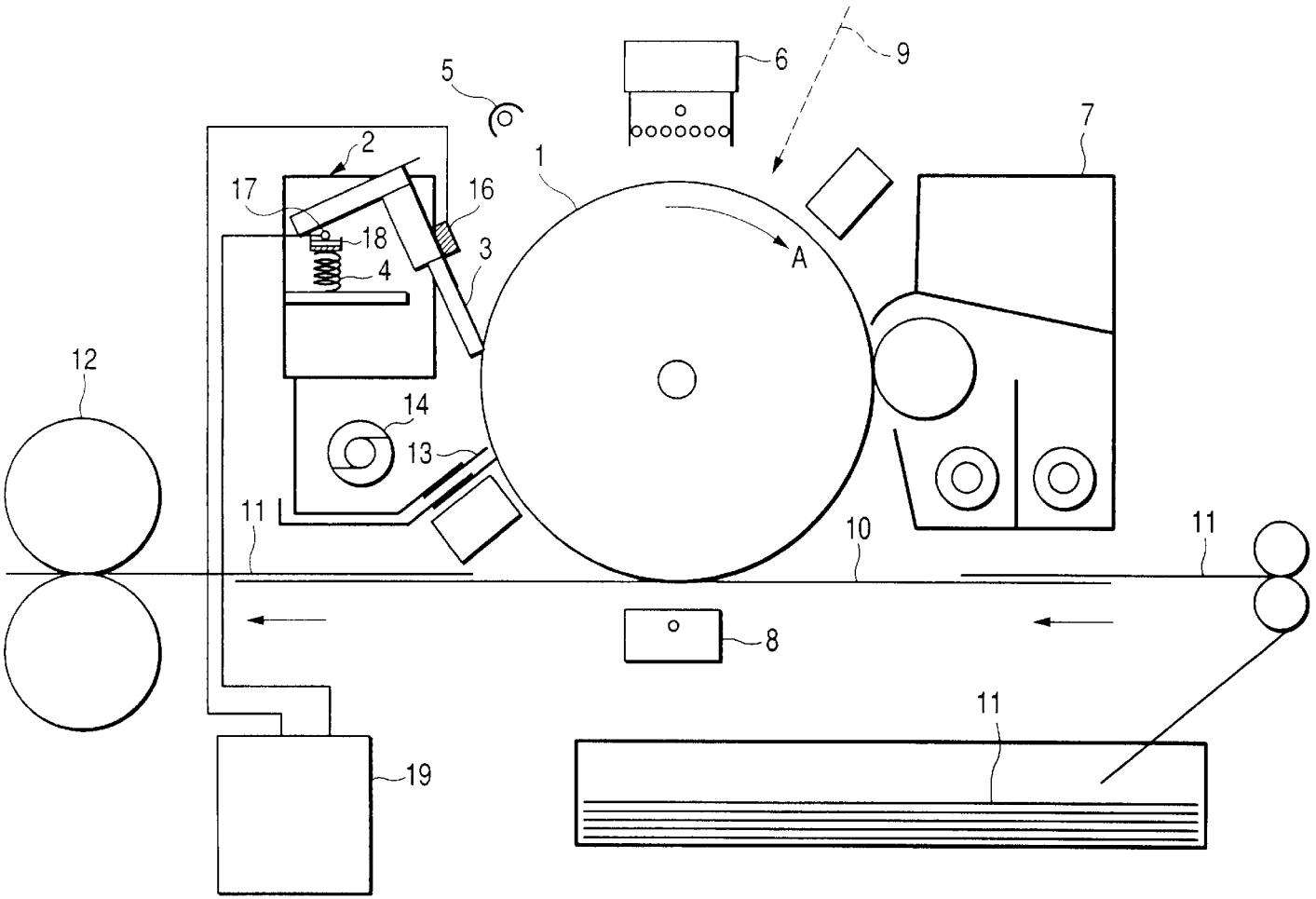
FIG. 5 is a sectional view of an image forming apparatus according to a fourth embodiment of the present invention.
Figure 6B:
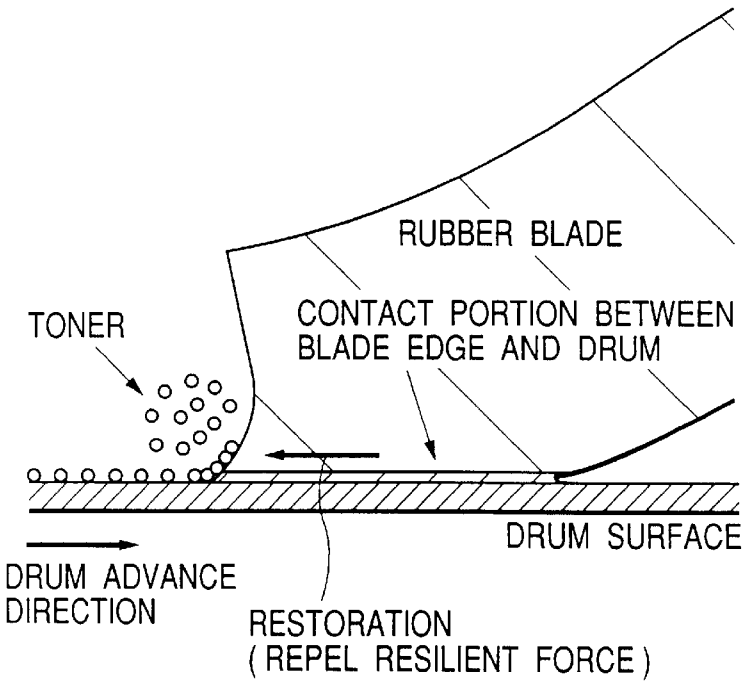
FIGS. 6A and 6B are conceptional views for explaining a mechanism of a cleaning action in a cleaning device.
Figure 6A:
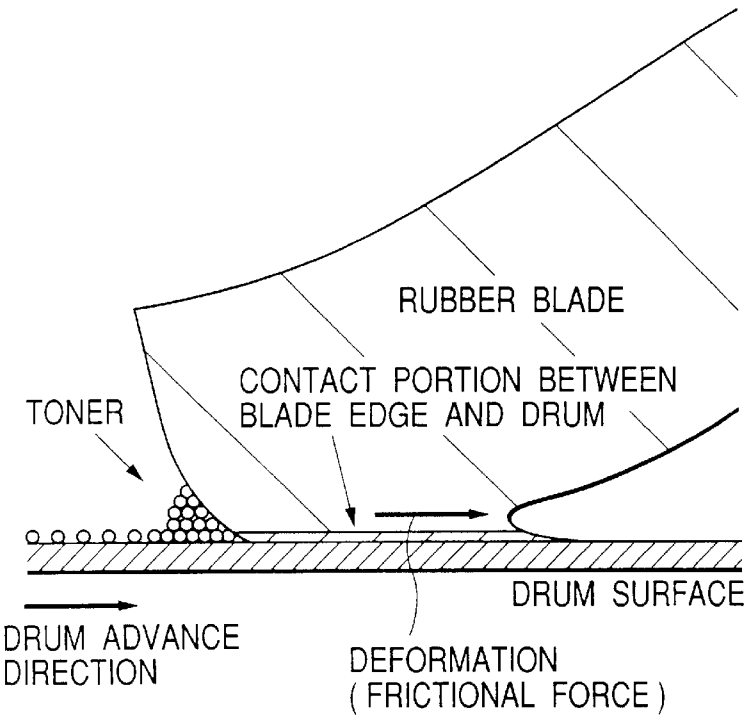
Figure 7B:
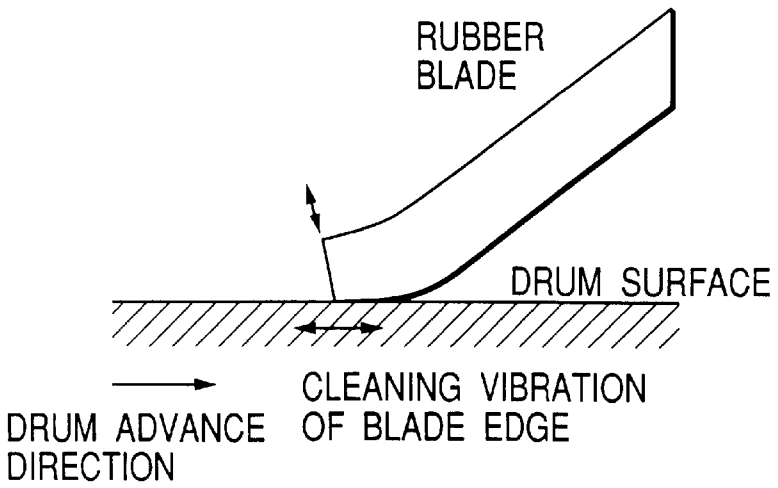
FIGS. 7A, 7B and 7C are conceptional views showing change in condition of the stick-slip movement of the edge portion of the cleaning blade and problems which may arise.
Figure 7A:
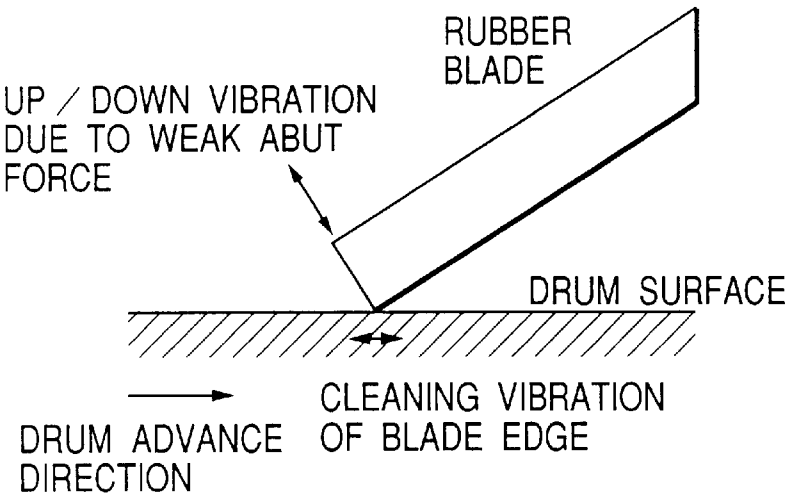
Figure 7C:
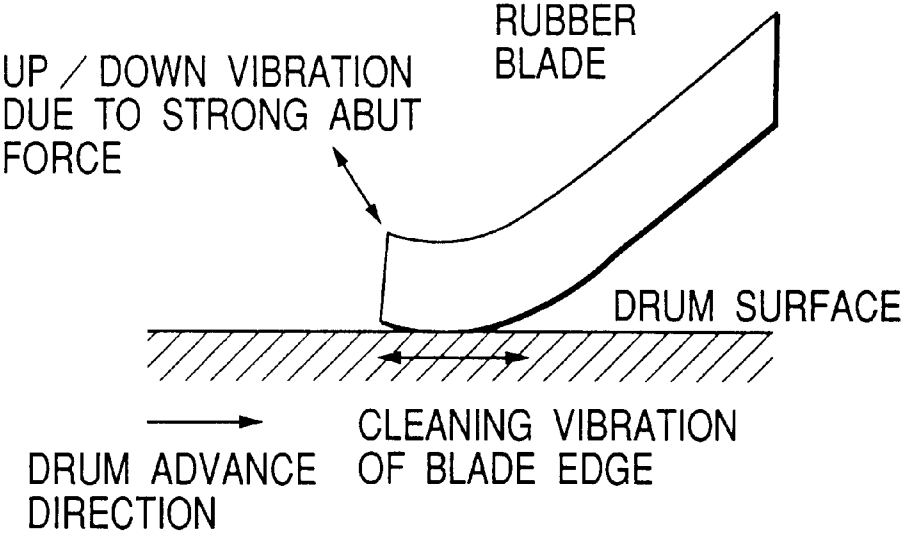

FIG. 5 is a conceptional sectional view of an image forming apparatus as an example of such an automatic diagnosis system. Incidentally, in FIG. 5, the same elements as those shown in FIG. 1 are designated by the same reference numerals and explanation thereof will be omitted.

In this image forming apparatus, a vibration detect sensor 17 for detecting the vibration condition of the edge portion of the cleaning blade 3 is provided on a metal plate of the cleaning blade 3, and a signal detected by the vibration detect sensor 17 is sent to a calculator 19, where the above-mentioned vibration condition of the edge portion of the cleaning blade 3 is judged. In this way, it is judged whether the pressing force of the cleaning blade 3 against the photosensitive drum 1 is greater than or smaller than a suitable value, and, by adjusting a pressure adjusting hydraulic pump 18, the pressing force effecting the good cleaning action is provided.

Here, conception of two kinds of methods for judging the vibration condition of the edge portion of the cleaning blade 3 in the calculator 18 will be explained.

(Type I)

(1) Detect the vibration of the cleaning blade edge by the vibration sensor;

(2) send the vibration signal for the cleaning blade edge from the vibration sensor to the calculator;

(3) add and average a time-integrated value of (voltage signal in the vibration measurement)−(voltage signal in reference)} per unit time every predetermined numbers in the calculator at any time;

(4) compare the added and averaged value of the time-integrated value in the above Item (3) with a threshold value when the cleaning condition is good;

(5) move the hydraulic pump in the pressurizing direction only when the value in the Item (4) is greater than the threshold value;

(6) effect the operations (1) to (4) again, and, move the hydraulic pump in the pressurizing direction again when the added and averaged value of the time-integrated value is smaller than the previous value or move the hydraulic pump in the depressurizing direction when the added and averaged value of the time-integrated value is smaller than the previous value; and (7) repeat the operations (1) to (6) until the added and averaged value of the time-integrated value becomes smaller than the threshold value.

(Type II)

(1) Detect the vibration of the cleaning blade edge by the vibration sensor;

(2) send the vibration signal for the cleaning blade edge from the vibration sensor to the calculator;

(3) pick-up a component of "maximum value of AC component of the voltage signal in the vibration measurement" within a predetermined time period in the calculator;

(4) compare the "maximum value of AC component of the voltage signal in the vibration measurement" with a threshold value when the cleaning condition is good, and effect operations (6) and so on only when the maximum value is greater than the threshold value;

(5) FFT-treat the voltage signal in the vibration measurement, and add and average power spectrum intensity of (two) frequencies associated with the cleaning action by predetermined times;

(6) judge one of two kinds the added and averaged values power spectrum intensity of two frequencies obtained by adding and averaging the power spectrum intensity of two frequencies by predetermined times, in which the frequency indicating a value is greater than the threshold value (judge strength and weakness of the press force of the cleaning blade);

(7) adjust the hydraulic pump in accordance with the judgement in the above Item (6);

(8) effect the operations (1) to (3) again; and (9) repeat the adjustment of the hydraulic pump until the maximum value of AC component of the voltage signal in the vibration measurement becomes smaller than the threshold value when the cleaning condition is good.

The use time period of the image forming apparatus having the above-mentioned cleaning device 2 until the poor image is generated by the cause of the cleaning device 2 under a high temperature/high humidity condition and a low temperature/low humidity condition is compared with that of the conventional image forming apparatus.

Comparison results are shown in the following Table 1.

(The service life time is one until the poor image is generated by the cause of the cleaning device.)

TABLE 1

Under high temperature/high humidity condition

| Hours | 100 | 200 | 300 | 400 | 500 | 600 | 700 | |
|---|---|---|---|---|---|---|---|---|
| Conventional No. 1 | ○ | ○ | ○ | X | X | X | X | 383 hours |
| Conventional No. 2 | ○ | ○ | X | X | X | X | X | 261 hours |
| Conventional No. 3 | ○ | ○ | X | X | X | X | X | 297 hours |
| Present Invention No. 1 | ○ | ○ | ○ | ○ | ○ | ○ | X | 630 hours |
| Present Invention No. 2 | ○ | ○ | ○ | ○ | ○ | X | X | 547 hours |
| Present Invention No. 3 | ○ | ○ | ○ | ○ | ○ | ○ | ○ | 711 hours |

○ Good :
X Bad
Average service life time of conventional machine 314 hours
Average service life time of the present invention 629 hours

TABLE 2

Under low temperature/low humidity condition

| Hours | 300 | 400 | 500 | 600 | 700 | 800 | 900 | |
|---|---|---|---|---|---|---|---|---|
| Conventional No. 1 | ○ | ○ | ○ | X | X | X | X | 564 hours |
| Conventional No. 2 | ○ | ○ | ○ | ○ | X | X | X | 650 hours |
| Conventional No. 3 | ○ | ○ | ○ | X | X | X | X | 591 hours |
| Present Invention No. 1 | ○ | ○ | ○ | ○ | ○ | X | X | 786 hours |
| Present Invention No. 2 | ○ | ○ | ○ | ○ | ○ | ○ | X | 849 hours |
| Present Invention No. 3 | ○ | ○ | ○ | ○ | ○ | ○ | X | 806 hours |

○ Good :
X Bad
Average service life time of conventional machine 602 hours
Average service life time of the present invention 814 hours From the test results, it can be seen that the effective use time period of the image forming apparatus having the cleaning device 2 according to the present invention is greater than that of the conventional image forming apparatus by about two times under the high temperature/high humidity condition and by about 1.35 times under the low temperature/low humidity condition.

As mentioned above, according to the present invention, in the image forming apparatus including the cleaning device having the cleaning blade, since the device for applying the vibration to the cleaning blade or the device for detecting the vibration condition of the cleaning blade is provided, the problems such as the escape of toner, fusion of toner on the image bearing member, abnormal noise, abnormal vibration and blade take-off can be solved, thereby providing the high quality image and lengthening the endurance.

Incidentally, the image bearing member associated with the above-mentioned cleaning device may be an intermediate transfer member on which the toner image is temporarily born in the process for transferring the toner image from the photosensitive member onto the transfer material, as well as the electrophotographic photosensitive member as described in connection with the embodiments. Further, the shape of the image bearing member is not limited to the drum but may be a belt.

What is claimed is:

1. An image forming apparatus including a cleaning device, said image forming apparatus comprising:

a toner image bearing member for bearing a toner image;

a cleaning blade for frictionally removing a residual toner remaining on said image bearing member after a transferring process; and a vibrating device for applying vibration having a steady-state vibration waveform to said cleaning blade, wherein the vibration waveform to be applied to said cleaning blade has a frequency and an amplitude required for providing energy for obtaining a cleaning action, and wherein a direction of the vibration applied to said cleaning blade, acting on an edge portion of said cleaning blade, is forcibly determined by an auxiliary member including a vibration proof member so that the direction is limited to a tangential plane of said image bearing member to prevent said cleaning blade from vibrating in a direction perpendicular to said image bearing member.

2. An image forming apparatus including a cleaning device, said image forming apparatus comprising:

a toner image bearing member for bearing a toner image;

a cleaning blade for frictionally removing a residual toner remaining on said image bearing member after a transferring process; and a vibrating device for applying vibration having a steady-state vibration waveform to said cleaning blade, wherein the vibration waveform to be applied to said cleaning blade has a frequency and an amplitude required for providing energy for obtaining a cleaning action, and wherein the vibration waveform to be applied to said cleaning blade is changed in accordance with a condition of said image bearing member.

3. An image forming apparatus including a cleaning device, said image forming apparatus comprising:

a toner image bearing member for bearing a toner image;

a cleaning blade for frictionally removing a residual toner remaining on said image bearing member after a transferring process; and a vibrating device for applying vibration having a steady-state vibration waveform to said cleaning blade, wherein the vibration applied to said cleaning blade has a frequency and an amplitude required for providing energy for obtaining a cleaning action, and wherein the vibration waveform to be applied to said cleaning blade is changed in response to a detected image density or residual toner amount on said image bearing member.

4. An image forming apparatus including a cleaning device, said image forming apparatus comprising:

a toner image bearing member for bearing a toner image;

a cleaning blade for frictionally removing a residual toner remaining on said bearing member after a transferring process;

a vibrating device for applying vibration having a steady-state vibration waveform to said cleaning blade; and a detecting device for detecting a vibration condition of said cleaning blade.

5. An image forming apparatus according to claim 4, wherein a cleaning condition of said cleaning device is judged by detecting the vibration condition of said cleaning blade.

6. An image forming apparatus according to claim 5, wherein a malfunction caused by using said cleaning device is known by detecting the vibration condition of said cleaning blade.

7. An image forming apparatus according to claim 6, wherein an amplitude value and a frequency value of the vibration waveform, and physical amounts derived from such two values are used to detect the vibration condition of said cleaning blade.

8. An image forming apparatus according to claim 5, wherein an amplitude value and a frequency value of the vibration waveform, and physical amounts derived from such two values are used to detect the vibration condition of said cleaning blade to thereby judge the cleaning condition of said cleaning device.

9. An image forming apparatus according to claim 5, wherein a malfunction caused by using said cleaning device is known by using an amplitude value and a frequency value of the vibration waveform, and physical amounts derived from such two values to detect the vibration condition of said cleaning blade.

10. An image forming apparatus according to claim 5, wherein an amplitude value and a frequency value of the vibration waveform, and threshold values of physical amounts derived from such two values are used to detect the vibration condition of said cleaning blade.

11. An image forming apparatus according to claim 5, wherein an amplitude value and a frequency value of the vibration waveform, and threshold values of physical amounts derived from the amplitude and frequency values to detect the vibration condition of said cleaning blade to thereby judge the cleaning condition of said cleaning device.

12. An image forming apparatus according to claim 5, wherein a malfunction caused by using said cleaning device is known by using an amplitude value and a frequency value of the vibration waveform, and threshold values of physical amounts derived from the amplitude and frequency values to detect the vibration condition of said cleaning blade.

13. An image forming apparatus according to claim 5, wherein said cleaning device includes an adjust mechanism for adjusting the vibration condition of said cleaning blade.

14. An image forming apparatus according to claim 5, wherein said cleaning device includes a pressure adjusting mechanism for adjusting an abut load amount of said cleaning blade against a surface of said image bearing member.

15. An image forming apparatus including a cleaning device, said image forming apparatus comprising:

a toner image bearing member for bearing a toner image;

a cleaning blade for frictionally removing a residual toner remaining on said bearing member after a transferring process; and a vibrating device for applying vibration to said cleaning blade, said vibration having a vibration waveform having a frequency and an amplitude required for providing energy for obtaining a cleaning action, wherein a direction of the vibration applied to said cleaning blade, acting on an edge portion of said cleaning blade, is forcibly determined by an auxiliary member including a vibration proof member so that the direction is limited to a tangential plane of said image bearing member to prevent said cleaning blade from vibrating in a direction perpendicular to said image bearing member.

16. An image forming apparatus including a cleaning device, said image form apparatus comprising:

a toner image bearing member for bearing a toner image;

a cleaning blade for frictionally removing a residual toner remaining on said bearing member after a transferring process; and a vibrating device for applying vibrating to said cleaning blade, said vibration having a frequency and an amplitude required for providing energy for obtaining a cleaning action, wherein the vibration waveform to be applied to said cleaning blade is changed in accordance with a condition of said image bearing member.

17. An image forming apparatus including a cleaning device, said image forming apparatus comprising:

a toner image bearing member for bearing a toner image;

a cleaning blade for frictionally removing a residual toner remaining on said bearing member after a transferring process; and a vibrating device for applying vibration to said cleaning blade, said vibration having a vibration waveform having a frequency and an amplitude required for providing energy for obtaining a cleaning action, wherein the vibration waveform to be applied to said cleaning blade is changed in response to a detected image density or residual toner amount on said image bearing member.

18. A cleaning device for use in an image forming apparatus including a toner image forming apparatus having a toner image bearing member for bearing a toner image, said cleaning device comprising:

a cleaning blade for frictionally removing a residual toner remaining on the image bearing member after a transferring process; and a vibrating device for applying vibration having a vibration waveform to said cleaning blade, said vibration waveform having a frequency and an amplitude required for providing energy for obtaining a cleaning action, wherein a direction of the vibration applied to said cleaning blade, acting on an edge portion of said cleaning blade, is forcibly determined by an auxiliary member so that the direction is limited to a tangential plane of the image bearing member to prevent said cleaning blade from vibrating in a direction perpendicular to the image bearing member.

19. A cleaning device for use in an image forming apparatus having a toner image bearing member for bearing a toner image, said cleaning device, said cleaning device comprising:

a cleaning blade for frictionally removing a residual toner remaining on the image bearing member after a transferring process; and a vibrating device for applying vibration having a vibration waveform to said cleaning blade, said vibration waveform having a frequency and an amplitude required for providing energy for obtaining a cleaning action, wherein the vibration waveform to be applied to said cleaning blade is changed in accordance with a condition of the image bearing member.

20. A cleaning device for use in an image forming apparatus having a toner image bearing member for bearing a toner image, said cleaning device comprising:

a cleaning blade for frictionally removing a residual toner remaining on the image bearing member after a transferring process; and a vibrating device for applying vibration having a vibration waveform to said cleaning blade, said vibration waveform having a frequency and an amplitude required for providing energy for obtaining a cleaning action, wherein the vibration waveform to be applied to said cleaning blade is changed in response to a detected image density or residual toner amount on the image bearing member.

21. A cleaning device for use in an image forming apparatus having a toner image bearing member for bearing a toner image , said cleaning device comprising:

a cleaning blade for frictionally removing a residual toner remaining on said bearing member after a transferring process;

a vibrating device for applying vibration having a vibration waveform to said cleaning blade; and a detecting device for detecting a vibration condition of said cleaning blade.

* * * * *

UNITED STATES PATENT AND TRADEMARK OFFICE

CERTIFICATE OF CORRECTION

PATENT NO. : 6,128,461

DATED : October 3, 2000

INVENTOR(S): TADANOBU YOSHIKAWA

It is certified that error appears in the above-identified patent and that said Letters Patent is hereby corrected as shown below:

COLUMN 2:

Line 16, "to" should read --on--.

COLUMN 4:

Line 66, "of" should read --of the--.

COLUMN 5:

Line 61, "press" should read --pressing--.

COLUMN 6:

Line 7, "piezo electric" should read --piezoelectric--.

COLUMN 7:

Line 38, "press" should read --pressing--.

Line 45, "press" should read --pressing--.

UNITED STATES PATENT AND TRADEMARK OFFICE

CERTIFICATE OF CORRECTION

PATENT NO. : 6,128,461

DATED : October 3, 2000

INVENTOR(S): TADANOBU YOSHIKAWA

It is certified that error appears in the above-identified patent and that said Letters Patent is hereby corrected as shown below:

COLUMN 8:

Line 13, "of" (second occurrence) should read --is--.

COLUMN 9:

Line 13, "}" should be deleted.

Line 57, "press" should read --pressing--.

COLUMN 11:

Line 14, "stead" should read --steady--.

Line 23, "vibration proof" should read --vibration-proof--.

Line 35, "stead" should read --steady--.

Line 50, "stead" should read --steady--.

UNITED STATES PATENT AND TRADEMARK OFFICE

CERTIFICATE OF CORRECTION

PATENT NO. : 6,128,461

DATED : October 3, 2000

INVENTOR(S): TADANOBU YOSHIKAWA

It is certified that error appears in the above-identified patent and that said Letters Patent is hereby corrected as shown below:

COLUMN 13:

Line 5, "form" should read --forming--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*